US006948788B1

(12) United States Patent
Tai

(10) Patent No.: US 6,948,788 B1
(45) Date of Patent: Sep. 27, 2005

(54) REMOVABLE DRAWER FRONT, METHOD OF ATTACHMENT AND CABINET

(75) Inventor: Chung Chee Tai, Ames, IA (US)

(73) Assignee: Hirsh Industries, Inc., Des Moines, IA (US)

( * ) Notice: Subject to any disclaimer, the term of this patent is extended or adjusted under 35 U.S.C. 154(b) by 0 days.

(21) Appl. No.: 10/375,947

(22) Filed: Feb. 28, 2003

(51) Int. Cl.[7] ..... A47B 88/00; A47B 88/02
(52) U.S. Cl. ..... 312/348.4; 312/204
(58) Field of Search ..... 312/204, 348.4, 312/248.4

(56) References Cited

U.S. PATENT DOCUMENTS

| | | | | |
|---|---|---|---|---|
| 1,222,451 | A * | 4/1917 | Ohnstrand | 312/348.4 |
| 3,024,075 | A * | 3/1962 | Howe | 312/348.4 |
| 3,179,480 | A | 4/1965 | Brinker | 312/348.4 |
| 3,273,952 | A | 9/1966 | Himelreich et al. | 312/348.4 X |
| 3,933,402 | A | 1/1976 | Peterson | 312/348.4 X |
| 4,902,080 | A * | 2/1990 | Berger | 312/348.4 |
| 5,161,870 | A | 11/1992 | Mason et al. | 312/348.4 |
| 5,364,181 | A * | 11/1994 | Scheible | 312/348.4 |
| 5,375,923 | A * | 12/1994 | Hall et al. | 312/348.4 |
| 5,547,272 | A * | 8/1996 | Paterson et al. | 312/348.4 X |
| 5,618,091 | A * | 4/1997 | Huber et al. | 312/348.4 X |
| 5,664,857 | A * | 9/1997 | Lautenschlager et al. | 312/348.4 |
| 5,683,158 | A * | 11/1997 | Lim | 312/204 X |
| 5,951,133 | A | 9/1999 | Dittberner et al. | 312/348.4 |
| 5,997,118 | A | 12/1999 | McBrayer et al. | 312/348.4 X |
| 6,183,053 | B1 * | 2/2001 | Foslien et al. | 312/348.4 X |
| 6,557,956 | B2 * | 5/2003 | Hightower | 312/204 |
| 2003/0020384 | A1 * | 1/2003 | Bush et al. | 312/348.4 |

FOREIGN PATENT DOCUMENTS

| | | | | |
|---|---|---|---|---|
| DE | 3600623 | A1 * | 7/1986 | 312/348.4 |
| EP | 316242 | A1 * | 5/1989 | 312/204 |
| JP | 04092605 | A * | 3/1992 | 312/348.4 |
| JP | 04183409 | A * | 6/1992 | 312/348.4 |
| JP | 05007515 | A * | 1/1993 | 312/348.4 |

* cited by examiner

*Primary Examiner*—Rodney B. White
(74) *Attorney, Agent, or Firm*—Ryndak & Suri

(57) ABSTRACT

A decorative drawer front readily attachable to an existing drawer front face is provided. The drawer front includes a cover panel dimensioned to cover the face of an existing drawer. A mounting rib extends rearwardly from the rear side of the cover panel and has a rearmost portion adapted to attach to the front face of an existing drawer. The mounting rib offsets the cover panel from the drawer front face when the drawer front is attached to the drawer face providing the appearance of a drawer front having substantial material thickness, which drawer front may also be contoured to provide an aesthetically desirable appearance.

23 Claims, 6 Drawing Sheets

120
116b
118b
120
118a
120
114b
25b
120
114a
120
116a
120

28c
36c
58
36d
58
101
102b
100b
101
100a
28d
58
28a
14
31
39
36a
58
101
102a
28b
36b
80
84b
88b
92
112b
46
42
94
112a
94
44
86
92
88a

REMOVABLE DRAWER FRONT, METHOD OF ATTACHMENT AND CABINET

FIELD OF THE INVENTION

This invention relates to a removable drawer front that readily attaches to an existing drawer face, and more particularly, to a drawer front having rear mounting projections which provide an offset between the drawer front and the existing drawer face.

BACKGROUND OF THE INVENTION

A need exists for a device and method that can be used to improve the appearance of conventional flat-faced metal filing cabinet drawer fronts.

In addition, cabinet drawer faces or heads and, in particular, file cabinet drawer faces, often become scratched, chipped, dented or marred through repeated use. The large number of parts as well as the substantial degree of skill required to replace conventional drawer fronts tends to deter the typical file cabinet owner from undertaking such a task. In addition, conventional drawer fronts lack the ability to conveniently attach to a drawer face having an existing handle.

A need therefore exists for a drawer front that is readily and conveniently attachable to an existing drawer face with only minimal parts and/or skill. A need further exists for a drawer front with the versatility to be installed on a wide range of drawer face types including drawer faces having either protruding handles or recessed handles.

SUMMARY OF THE INVENTION

In accordance with the present invention, a novel replacement or decorative drawer front is provided which is attachable or mountable over an existing or original drawer front face. Thus, the new drawer front is functional and can be decorative. Typically, the existing drawer front is a generally planar, vertical surface. The drawer front of the invention includes a cover panel dimensioned to substantially cover or overlay the entire existing drawer face. The cover panel has a front side and a rear side. Attachment of the novel drawer front over an existing drawer front of an existing cabinet, which may be a filing cabinet, for example, results in a novel cabinet. In one embodiment, at least one mounting rib or other suitable structure extends rearwardly from a generally central portion of the cover panel rear side. The mounting rib has a rearmost portion adapted to permit attachment and contact of the drawer front to the existing drawer front face. The mounting rib can be secured to the existing drawer front by any suitable structure. As used herein, the term rib is intended to include any type of projecting element that can provide the desired offset and can contact and form an attachment with the existing cabinet, such as with a fastener, which may be a threaded fastener or any other structure for accomplishing fastening.

In addition, typically at least one member, spaced from the mounting rib or ribs, is also provided and projects rearwardly from the rear side of the cover panel, the projecting member also having a rearmost surface. The projecting member rearmost surface is substantially coplanar with the mounting rib or ribs rearmost portion. Attaching the mounting rib and the rearwardly projecting member to the drawer face thereby provides an offset between the cover panel front side and the front face of the existing drawer.

Preferably, rearwardly extending sidewalls extend from the periphery of the cover panel resulting in a finished appearance that also gives the inventive drawer front that is attached over the existing drawer front face the appearance of having a substantial material thickness that can be much greater than the actual material thickness of the cover panel. This also allows the drawer front to be contoured for a sleeker appearance, and thus may be concave or convex.

The cover panel may have any suitable or desired shape and contour and typically will be rectangular with an overall planar, concave or convex front surface, for example. Typically, the cover panel may have a material thickness from about 0.05 inches to about 0.25 inches, although with the offset provided by the mounting rib or ribs, the projecting member and sidewalls, the appearance of substantial thickness is achieved. Consequently, the surface of the cover panel may exhibit an aesthetically pleasing contour, such as convex or concave, as desired. In addition, the offset permits a recessed handle to be provided, if desired, that can extend across an upper portion of the cover panel without the need to modify or to otherwise provide an opening for a recessed handle in the original drawer front face.

In one embodiment, the cover panel front side has a generally rectangular overall shape typically for attachment over an existing drawer front face that is of a similar rectangular shape and size. Rearwardly extending perimeter sidewalls integral to the front side of the cover panel can be provided to extend rearwardly from the cover panel perimeter and when attached to the existing drawer front face are in close proximity to, or in contact with, the existing or original drawer front face. The sidewalls may have a material thickness substantially similar to the cover panel material thickness. This gives the drawer front the appearance of being made of a solid material and having a material thickness substantially greater than the actual material thickness of the cover panel.

In one embodiment, the attachable replacement or new drawer front also includes a plurality of projections located in spaced apart relation along the rear perimeter of the cover panel. These spaced apart projections may include at least one projection member. The projections extend generally rearwardly, each having a rearmost surface. Each rearmost surface typically is preferably substantially coplanar with the rearmost surface of the mounting rib and the projecting member. The rearmost surface of each projection is substantially flat. Optionally, any suitable material for adherence, such as adhesive material including double-sided adhesive tape, for example, placed on at least a portion of each projection rearmost surface, can be provided to secure each projection to the existing cabinet drawer front face. Such an arrangement helps to provide a secure and rigid attachment of the attachable drawer front to the existing cabinet drawer front face. In one embodiment, a recessed handle or drawer pull is provided in the replacement drawer front in which a rear surface of the recessed handle forms the projection or one of the projections for providing the desired offset and orientation of the new drawer front to the existing drawer front.

In one embodiment, the new drawer front includes a second mounting rib which is spaced from the other mounting rib and extends rearwardly from the rear side of the cover panel and has a rearmost portion substantially coplanar with the rearmost portion of the other mounting rib. The second mounting rib is adapted to permit the front side of the cover panel to be offset from the existing drawer front face when the drawer front is attached to the existing front face. Each mounting rib has a rib aperture adapted to receive a fastening device for securing the attachable drawer front to the existing cabinet drawer front face. A fastening device is inserted through the rear side of the existing drawer front face, typically in a generally central portion of the drawer face corresponding to the location of each mounting rib. Each fastening device is secured in a corresponding rib aperture to offset the cover panel from the existing drawer front face. Any suitable fastening arrangement can be used to secure the new drawer front over the existing drawer front and any suitable fastening device can be used, such as various types of threaded fasteners, studs and rivets, for example.

The existing drawer front face may include preexisting holes in a particular location. These holes may be exposed as a result of removing an existing handle from the existing drawer front face. Depending on the size of the existing hole(s), a bushing may be inserted into each preexisting hole to accommodate a desired diameter fastening device therethrough. Typically, a fastening device is inserted through each bushing, if present, and secured into a corresponding mounting rib. Each mounting rib typically will have one or more apertures adapted to receive both a portion of the bushing as well as to secure and receive a portion of the fastening device.

Other arrangements may be used to secure the new drawer front to the existing or original drawer front face. In one alternate embodiment, the existing drawer front face includes an opening which is exposed as a result of removing a recessed handle from the drawer front face, which opening may be a relatively large rectangular opening. One or more and preferably two bridging members are provided that may each include a protruding portion and a base portion oriented so that the base portion bridges the opening. The protruding portion of the bridging member has an aperture extending through the bridging member allowing a fastening device to pass therethrough, which protruding member may be an integral bushing. The base portion of the bridging member may include a flange portion that overlaps a portion of the rear surface of the existing drawer front face. The rearmost portion of the mounting rib has an aperture adapted to receive the protruding portion as well as securably receiving a portion of the fastening device. In use, the bridging member is placed in position to bridge the opening corresponding to the location of mounting rib. Two bridging members are used typically when the mounting ribs are provided and will be arrayed in a spaced apart relationship (depending on the size of the opening in the original drawer front and the location of the mounting ribs). The fastening device is inserted through the aperture in the protruding portion of the bridging member and securably attached in the rib aperture of the mounting rib. This secures the cover panel to the existing drawer front having a large opening.

In accordance with another aspect of the invention, multiple pairs of mounting ribs are provided that extend rearwardly from a central portion of the rear side of the cover panel. These pairs of mounting ribs are adapted to attach to an existing drawer front face having an opening as previously described. The multiple pairs of mounting ribs are spaced apart to accommodate a wide range of opening sizes. Each mounting rib has a rib aperture and a rearmost portion which is adapted to receive both a portion of a fastening device as well as the protruding portion, if present, of a bridging member as previously described.

In accordance with another aspect of the present invention, a method for attaching a new drawer front over an existing drawer having an existing front face is provided. The method includes providing a cover panel which is sized to cover the front face of the drawer. The cover panel has a front side and a rear side and a mounting rib extending rearwardly from a generally central portion of the rear side. The method further includes attaching the mounting rib to the front face of the drawer and offsetting the front side of the cover panel from the front face of the drawer with the mounting rib. This gives the new drawer face the appearance of substantial material thickness and permits the new drawer front to be contoured (i.e., concave or convex, for example) as well as having, if desired, a recessed handle that is integral with the new drawer front without modifying the existing drawer front face.

In one embodiment of the method, the mounting rib further comprises an aperture adapted to securably receive a fastening member. The method includes removing a handle from the front face of the existing drawer (if present) to expose an existing opening in the front face of the drawer. If no holes are present in the existing drawer front, a hole or holes can be formed in the desired location(s) by any suitable method, such as by drilling, for example. A fastening member is inserted through the opening and into a portion of the mounting rib aperture to secure the mounting rib to the drawer front face. The cover panel further includes at least one and preferably a plurality of projections extending generally rearwardly from the rear side of the cover panel, each projection preferably having a rearmost surface substantially coplanar with each other and the rearmost portion of the mounting rib. The method further includes fastening the cover panel to the drawer face so that the most rearward portions of the rib and the projections are in a fixed, abutting relation to the drawer face.

In one embodiment, the existing opening in the front face of the existing drawer is relatively large, such as to accommodate a recessed handle and may be a generally rectangular opening. The method further includes placing one or more bridging members that span the opening and inserting a fastening device through the bridging member to maintain the bridging member in a fixed position across and to secure the new drawer front to the bridging member and thus to the existing front drawer face.

DETAILED DESCRIPTION OF THE PREFERRED EMBODIMENTS

Figure 1:
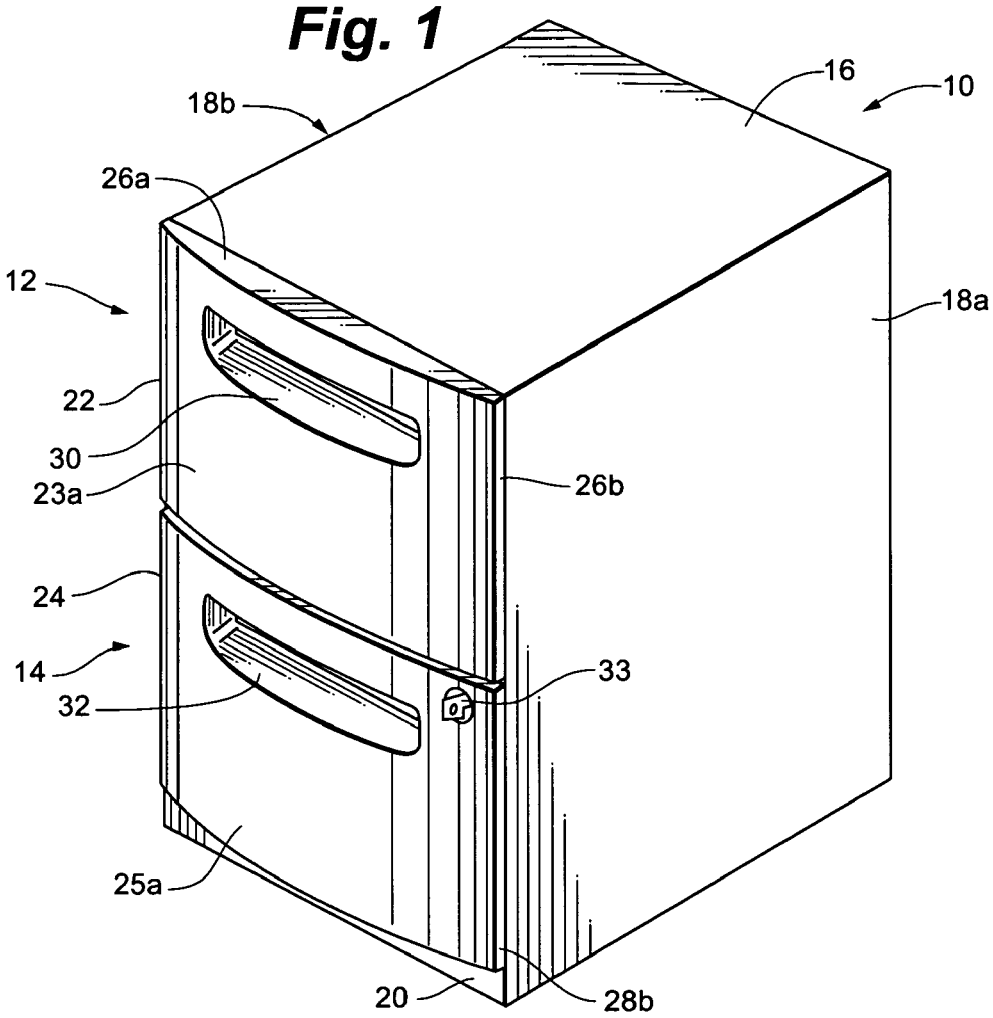
FIG. 1 is a perspective view of drawer fronts attached to drawer faces of a cabinet and the resulting cabinet, all in accordance with the present invention.
Figure 2:
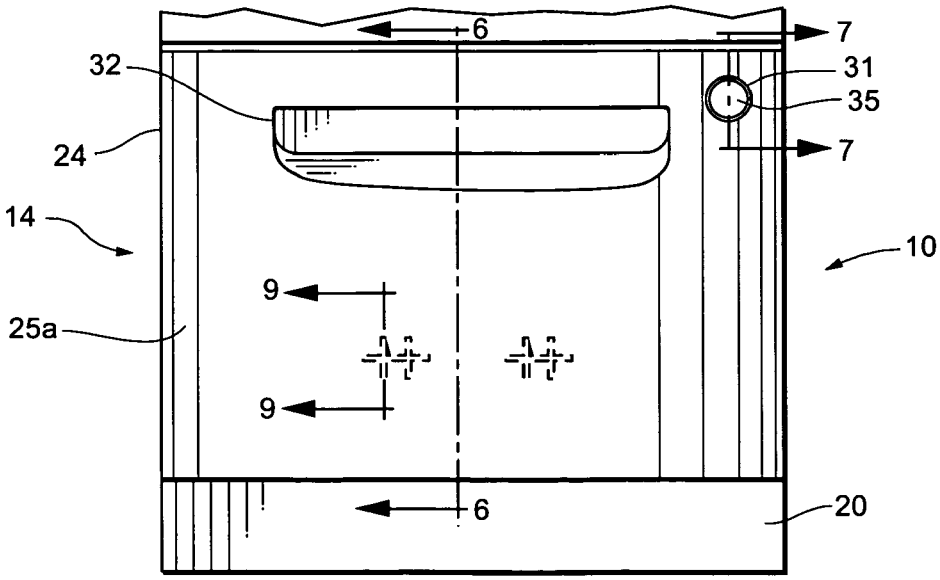
FIG. 2 is a front elevation fragmentary view of a portion of the cabinet of FIG. 1, including the lower drawer front.

Referring to the FIGURES generally, where like reference numerals denote like structure and elements, and in particular to FIGS. 1 and 2, a cabinet 10 in accordance with the invention is depicted comprising decorative drawer fronts 12 and 14, which are attached to drawers, each having an existing drawer front, an upper surface 16, side surface walls 18*a* and 18*b* and a base 20. While cabinet 10 is a file cabinet, the invention is generally applicable to cabinets that have a front drawer or door panel. Drawer fronts 12 and 14 each have a corresponding cover panel 22 and 24 with each cover panel 22 and 24 having a corresponding front side 23*a* and 25*a*. Each cover panel 22 and 24 is of a suitable size and shape to substantially or entirely cover the front face of each drawer of cabinet 10. As shown in FIGS. 1 and 2, cover panels 22 and 24 are rectangular in shape and typically correspond to the shape or front outline of the existing drawer front, although such correspondence is not required but typically desired for aesthetic purposes. Thus, the cover panels may be any desired front outline shape, although typically that shape will be rectangular since typically existing cabinet drawer fronts are rectangular. The cover panels may have rounded edges and/or corners. Preferably, the cover panel spans or otherwise covers the entire front face of an existing drawer. However, as previously described, a drawer front allowing partial exposure of the front face of an existing drawer is also within the scope of the present invention.

Drawer fronts 12 and 14 may also be contoured for aesthetic purposes as desired. FIG. 1 for example, shows drawer fronts 12 and 14 having a convex contour with the center portion of cover panels 22 and 24 exhibiting more forward protrusion than the edges of the cover panels. Alternatively, drawer fronts 12 and 14 may be concave in contour wherein the edges of cover panels 22 and 24 protrude more than the center portion of the cover panels. The axis of the contour may also be oriented as desired, i.e., horizontal as shown in FIG. 1, vertical, or otherwise. The surface may have some other relief shape or design and may also be textured, for example.

Each drawer front preferably also has sidewalls that extend rearwardly from the perimeter of the cover panel. FIG. 1 shows a top sidewall 26*a* and a right sidewall 26*b* extending rearwardly from cover panel 22 and overlying the front surface of cabinet 10. Also shown is right sidewall 28*b* of cover panel 24. One of ordinary skill in the art will realize that other orientations with cabinet 10 are within the scope of the present invention. For example, decorative drawer front 12 may be either partially inset or fully inset in cabinet 10. The convex shape of top sidewall 26*a* further illustrates the convex contour of drawer front 12. The center portion of top sidewall 26*a* extends outward to a greater degree than do the ends of top sidewall 26*a*. Drawer fronts 12 and 14 each have a respective recessed handle or drawer pull 30 and 32 allowing a person to grasp the handle and pull open the cabinet drawer.

Alternatively, each decorative drawer front may have a protruding handle (not shown). Drawer front 12 and drawer front 14 are substantially the same with the exception that drawer front 14 includes a lock hole 31. Lock hole 31 allows a key 33 to engage and actuate a locking mechanism 35 used to lock the drawers of cabinet 10 as is commonly provided in various types of cabinets. Thus, with the exception of lock hole 31 and surrounding area, drawer fronts 12 and 14 are identical.

While cabinet 10 is a two-drawer file cabinet, the invention is suitable for any type of cabinet, including those typically used in the home, office, restaurant, hospital or other institution as known in the art, as well as being a component of a larger furniture item such as a desk, an entertainment center, cabinetry such as a bathroom vanity or kitchen or closet cabinetry having one or more drawers. While cabinet 10 is a two-drawer file cabinet, the invention is not limited to any set number, width or configuration of drawers. Hence, although the preferred embodiments illustrate a file cabinet, the present invention is applicable to drawers and doors, for example.

Figure 3:
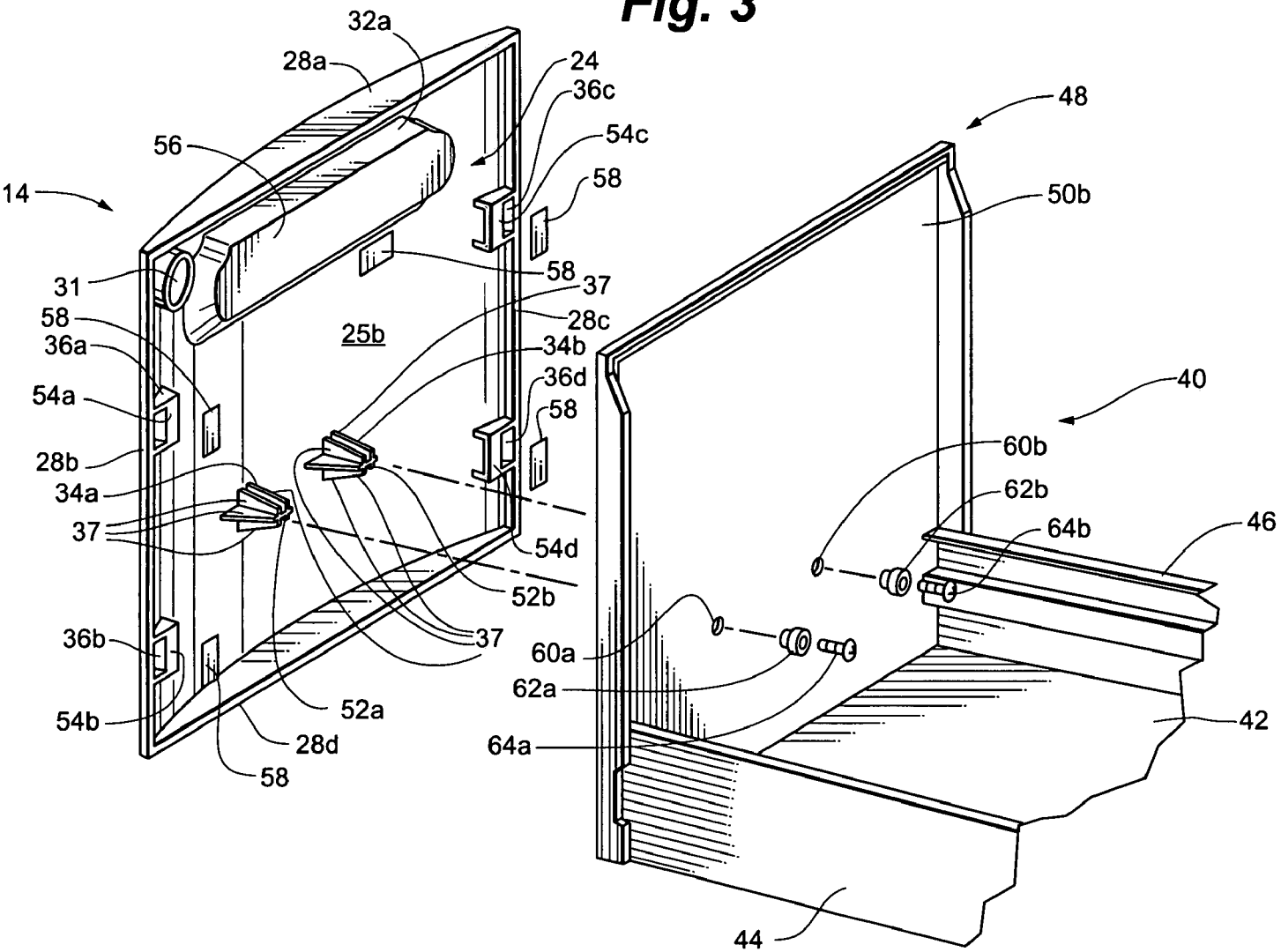
FIG. 3 is an exploded, fragmentary rear perspective view of the lower drawer front and drawer of FIG. 2.

FIG. 3 shows the rear side of drawer front 14 which includes a rear side 25*b* of cover panel 24, mounting ribs 34*a* and 34*b*, a rear side 32*a* of recessed handle 32, a lock hole 31, and projections 36*a*, 36*b*, 36*c* and 36*d*. Also shown in FIG. 3 are top sidewall 28*a*, a right sidewall 28*b*, a left sidewall 28*c*, and a bottom sidewall 28*d*. Decorative or aesthetic drawer front 14 may be made of any suitable material, including, but not limited to, a polymer material, metal, wood, or a fiber material. Mounting ribs 34*a* and 34*b*, projections 36*a*–36*d*, sidewalls 28*a*–28*d*, recessed handle 32 and lock hole 31 are preferably integrally formed but may be provided and fixed in place by any suitable manner to cover panel 24 as is commonly known in the art, including, but not limited to, adhesively attached, welded, bolted, bonded, riveted or screwed. Preferably, drawer front 14 is an integral, unitary member of a molded polymer material. Thus, mounting ribs 34*a* and 34*b*, projections 36*a*–36*d*, recessed handle 32, lock hole 31 and sidewalls 28*a*–28*d* are integral to drawer front 14. Typically, cover panel 24 and sidewalls 28*a*–28*d* may have a thickness from about 0.05 inches to about 0.25 inches, although any suitable or desired thickness can be utilized as will be known in the art.

As shown in FIG. 2 (in phantom) and FIG. 3, mounting ribs 34*a* and 34*b* are located in a generally central portion of rear side 25*b* of cover panel 24. Each of mounting ribs 34*a* and 34*b* includes a plurality of fins 37 that support, strengthen and maintain the structure and length of ribs 34*a* and 34*b* when secured to a drawer face. Mounting ribs 34*a* and 34*b* may be made of any material suitable to securably receive a fastening device including, but not limited to, metal, wood, plastic or combinations thereof. Mounting ribs 34*a* and 34*b* may or may not be the same material as cover panel 24. The distance between mounting ribs 34*a* and 34*b* may be determined based on the design requirements of drawer front 14. For example, a wide, rectangular-shaped drawer face may require the distance between mounting ribs 34*a* and 34*b* to be greater as opposed to a smaller, square-shaped drawer face. Thus, the position between mounting ribs 34*a* and 34*b* and the distance therebetween may be established in an attempt to optimize stability of drawer front 14 when mounted upon a drawer face. In like manner, projections 36*a*–36*d* may be spaced apart along the perimeter of cover panel rear side 25*b* to provide stability to drawer front 24 when attached to a drawer. The projections may or may not be attached to sidewalls 28*a*–28*d*. Preferably, projections 36*a*–36*d* are equally spaced apart along right and left sidewalls 28*b* and 28*c*, with projections 36*a* and 36*b* being attached to right sidewall 28*b* and projections 36*c* and 36*d* being attached to left sidewall 28*c* as shown in FIG. 3. Projections 36*a*–36*d* could be replaced by a continuous projection extending along the rear periphery of cover panel 24, for example.

Figure 4:
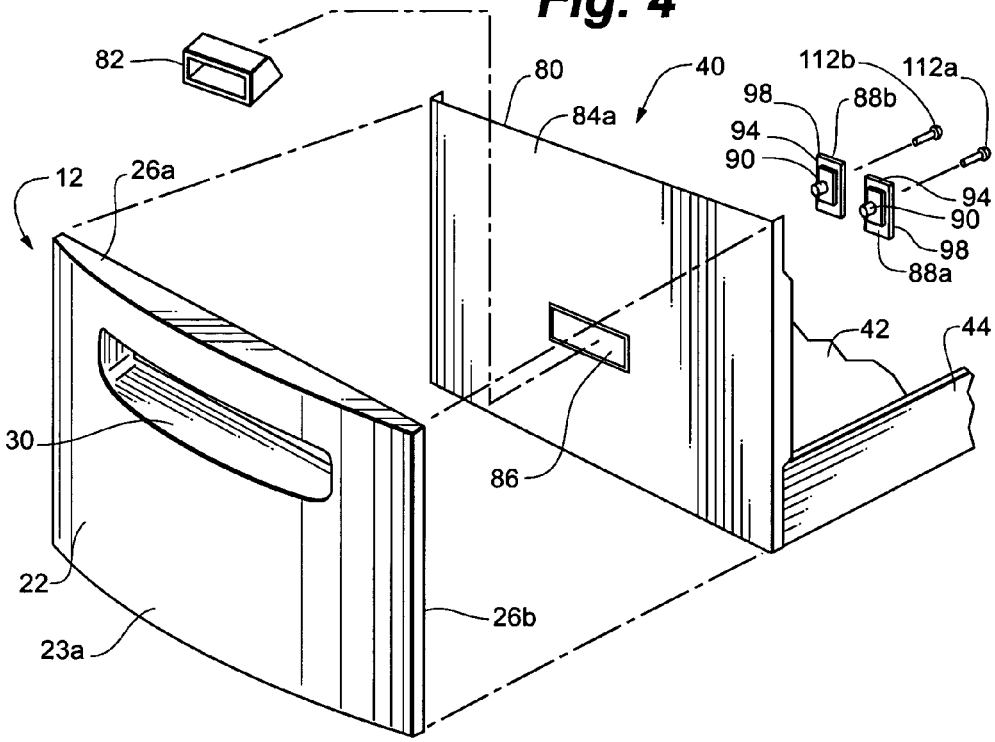
FIG. 4 is a front perspective view of the upper drawer front of FIG. 1 attached to a drawer front wall with a recessed drawer handle removed.
Figure 5:
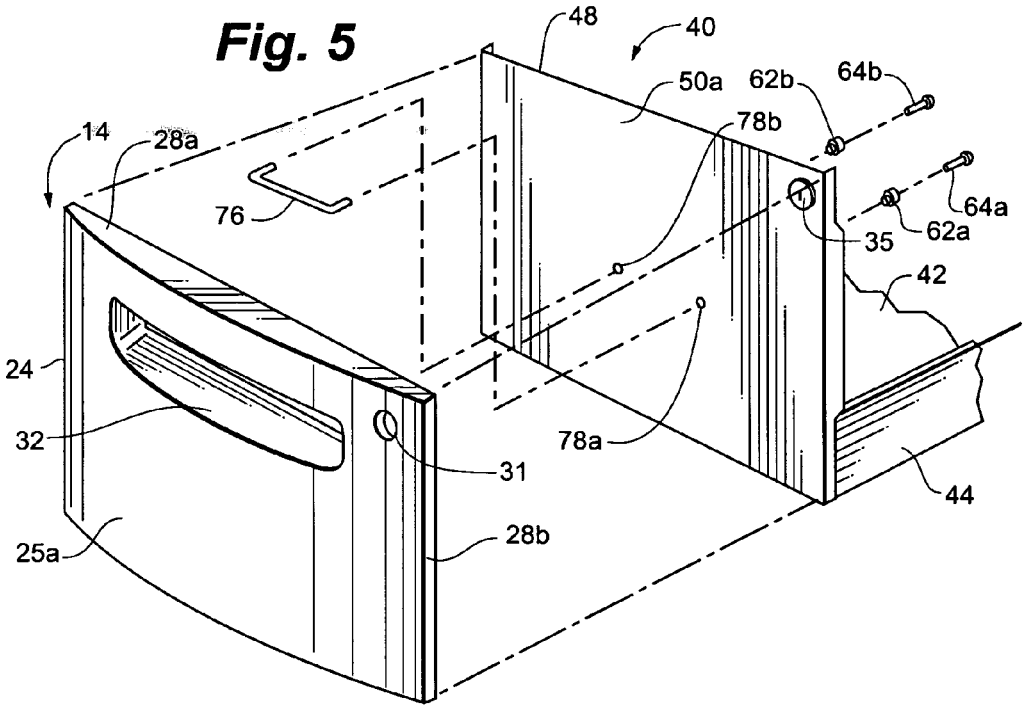
FIG. 5 is a front perspective view of the lower drawer front of FIG. 1 attached to a drawer front wall with a protruding drawer handle removed.

Drawer front 14 is attachable to a drawer 40 as shown in FIGS. 3–5. Drawer 40 includes a bottom wall 42, first and second sidewalls 44 and 46 and a front wall 48 having a drawer face 50*a* and a rear surface 50*b*. Drawer 40 may be any pull-type drawer as is commonly known in the art. Typically, front drawer face 50*a* is flat or substantially planar. Mounting ribs 34*a* and 34*b* extend rearwardly from rear side 25*b* of the cover panel 24 and each rib 34*a* and 34*b* has a rearmost portion 52*a* and 52*b*, respectively. Other members may be provided that project rearwardly from rear side 25*b* of cover panel 24 including projections 36*a*–36*d* and rear side 32*a* of recessed handle 32. Each projection 36*a*, 36*b*, 36*c* and 36*d* has a corresponding rearmost surface 54*a*, 54*b*, 54*c*, and 54*d*, which in this case are planar. Rear side 32*a* of recessed handle 32 also has a relatively large rearmost surface 56, which in this case is planar. Preferably, rearmost portions 52*a*–52*b* and all of rearmost surfaces 54*a*–54*d* and 56 are substantially coplanar. Thus, given the convexity of drawer front 14, the rearward length for many of the members projecting rearwardly from rear side 25*b* may differ. For example, as recessed handle 32 is located generally in a central portion of drawer front 14, the depth of the rear side of recessed handle 32*a* will typically be greater than the depth of any of projections 36*a*–36*d*.

Drawer front 14 may be secured to the old or existing cabinet drawer front by any suitable structure and method. As illustrated, a fastening device inserted through rear surface 50*b* of drawer front wall 48 and into one of mounting ribs 34*a* or 34*b* secures drawer front 14 to drawer front wall 48. The fastening device may include any commonly known device such as a nail, a screw, a bolt, or a rivet, for example. Mounting rib 34*a* or 34*b* may be suitably constructed to securably receive the fastening device. For example, the mounting rib may typically be made of a solid material such as wood or a synthetic substitute thereof so as to adequately and securably receive a nail inserted through drawer front wall 48. At least one rearwardly projecting member may provide additional stability to mounted drawer front 14 through contact between the rearmost surface of the rearwardly projecting member and drawer face 50*a*.

An adhesive material 58 may also be applied to one, some or all the rearmost surfaces of cover panel rear side 25*b* to further secure drawer front 14 to drawer front wall 48. As shown in FIG. 3, adhesive material 58 may be applied to rearmost surfaces 54*a*–54*d* as well as to rearmost surface 56. In one embodiment, adhesive material 58 is two-sided tape.

In an alternate embodiment, drawer front wall 48 further comprises holes 60*a* and 60*b* as shown in FIG. 3. The rear side of drawer front 14 is placed against drawer face 50*a* in an abutting manner such that rearmost portions 52*a* and 52*b* of ribs 34*a* and 34*b* and the coplanar rearmost surfaces are substantially coplanar with drawer face 50*a*. Bushings 62*a* and 62*b* are inserted into holes 60*a* and 60*b* respectively. Holes 60*a* and 60*b* may be pre-existing holes. Alternatively, holes 60*a* and 60*b* may be formed in preparation of attachment of drawer front 14 to drawer front wall 48 by any suitable method commonly known in the art such as by drilling, for example. Screws 64*a* and 64*b* may then be inserted through bushings 62*a* and 62*b*, respectively. Mounting ribs 34*a* and 34*b* align with and correspond to holes 60*a* and 60*b*, respectively, so that drawer front 14 covers substantially the entire drawer front face 50*a* when screws 64*a* and 64*b* are secured into mounting ribs 34*a* and 34*b*, respectively, as shown in FIG. 6.

Figure 9:
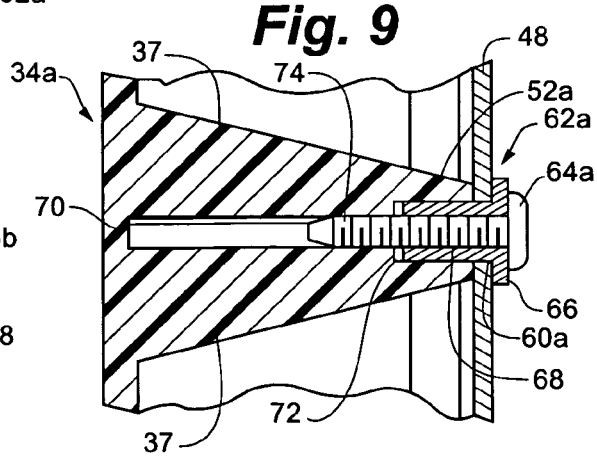
FIG. 9 is a fragmentary sectional view taken along line 9—9 of FIG. 2 illustrating a mounting rib attached to a front drawer face.

As best seen in FIG. 9, bushing 62*a* includes a lip 66 and an annular elongated body 68. Lip 66 and annular elongated body 68 align screw 64*a* as screw 64*a* extends through hole 60*a*. Mounting rib 34*a* includes an elongated aperture 70 that may extend along the entire, or a substantial portion of, the length of mounting rib 34*a*. At rearmost or entry portion 52*a* of mounting rib 34*a*, the diameter of aperture 70 may increase to form a cavity 72 to accommodate a bushing, for example. Thus, elongated body 68 fits into cavity 72 in a mated relation. Screw 64*a* has a threaded portion 74 which extends through elongated body 68 and into aperture 70 where it threadably engages the interior surfaces of aperture 70. Screw 64*b* extending through bushing 62*b* and hole 60*b* engages and secures to mounting rib 34*b* in a similar manner as herein described. In addition, adhesive material 58 may be applied to rearmost surfaces 54*a*–54*d* and 56 to further secure drawer front 14 to front drawer face 50*a* as seen in FIGS. 3 and 6.

Figure 6:
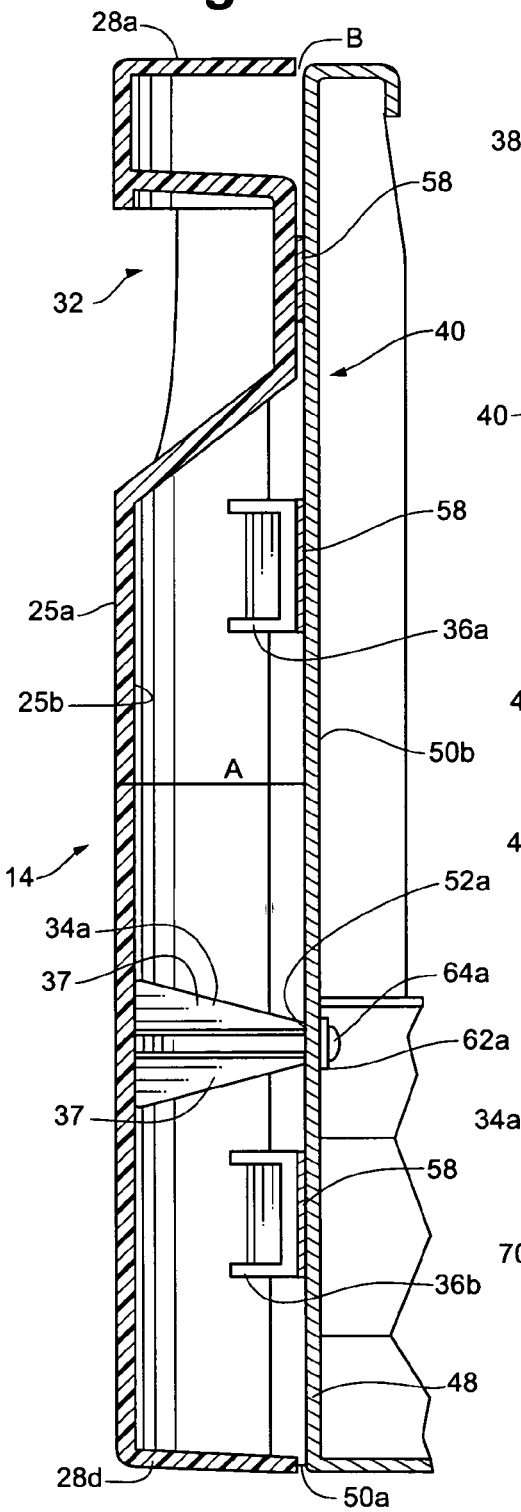
FIG. 6 is a fragmentary sectional view taken along line 6—6 of FIG. 2 illustrating the lower drawer front attached to an existing drawer front wall.

An important aspect of the present invention is the offset formed between front side 25*a* of cover panel 24 and drawer front face 50*a* as shown in FIG. 6. The rearward extent of mounting rib 34*a*, projections 36*a* and 36*b* and rearmost surface 56 of recessed handle 32 provides an offsetting distance A between front side 25*a* of cover panel 24 and drawer front face 50*a*. This provides drawer front face 50*a* with the appearance of added depth even though cover panel 24 is about 0.10–0.50 inches thick. Distance A typically is about 0.5 inches to about 2.5 inches or as otherwise desired. Drawer front 14 typically weighs less than one pound and thereby provides an appealing, lightweight enhancement to an existing drawer front.

The offset can create a slight gap B between the rearmost extent of the sidewalls and drawer face 50*a*, in particular top side wall 28*a* and bottom sidewall 28*d* as shown in FIG. 6. Typically, gap B may be from about 0 (i.e., no gap) to about 0.10 inch. The absence of or a narrow gap between sidewalls 28*a*–28*d* and front face 50*a* gives the appearance that drawer front 14 is composed of a unitary piece of solid material. This further enhances the drawer face by providing the drawer face with the appearance of sturdiness and/or durability.

In an alternate embodiment of the invention, holes 78*a* and 78*b* are pre-existing holes which are exposed by removing a protruding handle 76 from drawer front wall 48 as shown in FIG. 5. Handle 76 is removed from drawer front wall 48 as is commonly known in the art, typically by removing the fastening device which secures handle 76 to drawer front wall 48. Preferably, drawer front 14 is designed so that the location of mounting ribs 34*a* and 34*b* align with or otherwise correspond to the position of holes 78*a* and 78*b* on drawer face 50*a*. Screws 64*a* and 64*b* and bushings 62*a* and 62*b* are used to secure drawer front 14 to drawer front wall 48 as previously described.

Figure 7:
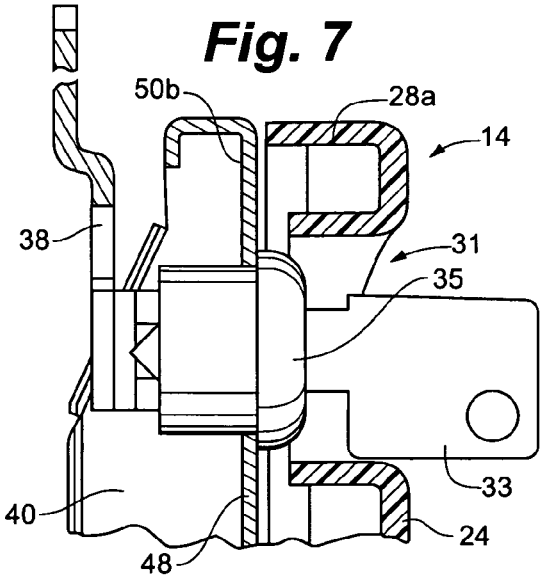
FIG. 7 is a fragmentary sectional view taken along line 7—7 of FIG. 2 illustrating a lock hole.
Figure 8:
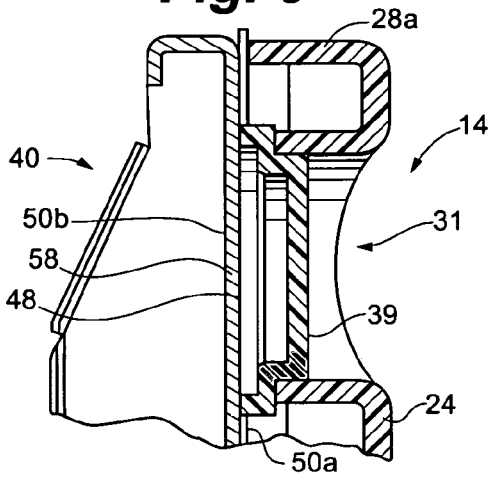
FIG. 8 is a fragmentary sectional view illustrating an alternate embodiment from FIG. 7.

Lock hole 31 provides access to locking mechanism 35 with key 33 as shown in FIGS. 5 and 7. When actuated by key 33, locking mechanism 35 engages a locking arm 38 preventing drawer 40 from opening. Locking arm 38 may prevent either one drawer or all drawers of cabinet 10 from opening as is commonly known in the art. In the event cabinet 10 has no drawer locking mechanism, a lock plug 39 may be inserted into lock hole 31 as shown in FIGS. 8 and 10 to provide a finished look.

In an alternate embodiment, drawer 40 has a front wall 80 having a recessed handle 82 as shown in FIG. 4. Front wall 80 also includes a drawer front face 84*a* and a rear surface 84*b*. For attachment of the new drawer front, recessed handle 82 is removed from front wall 80. This exposes an opening 86 into which bridging members 88*a* and 88*b* may be inserted.

As seen in FIGS. 4, 10 and 12–14, each bridging member includes a pin portion 90 having an aperture 92 and a base portion 94. Base portion 94 has a lip 96 that abuts against the interior surfaces of drawer front wall 80 that define opening 86. Each bridging member has a flange portion 98 which extends over a portion of rear surface 84*b* when lip 96 is in abutment with opening 86. Lip 96 and flange portion 98 thereby maintain the bridging members in opening 86.

Figures 10, 11:
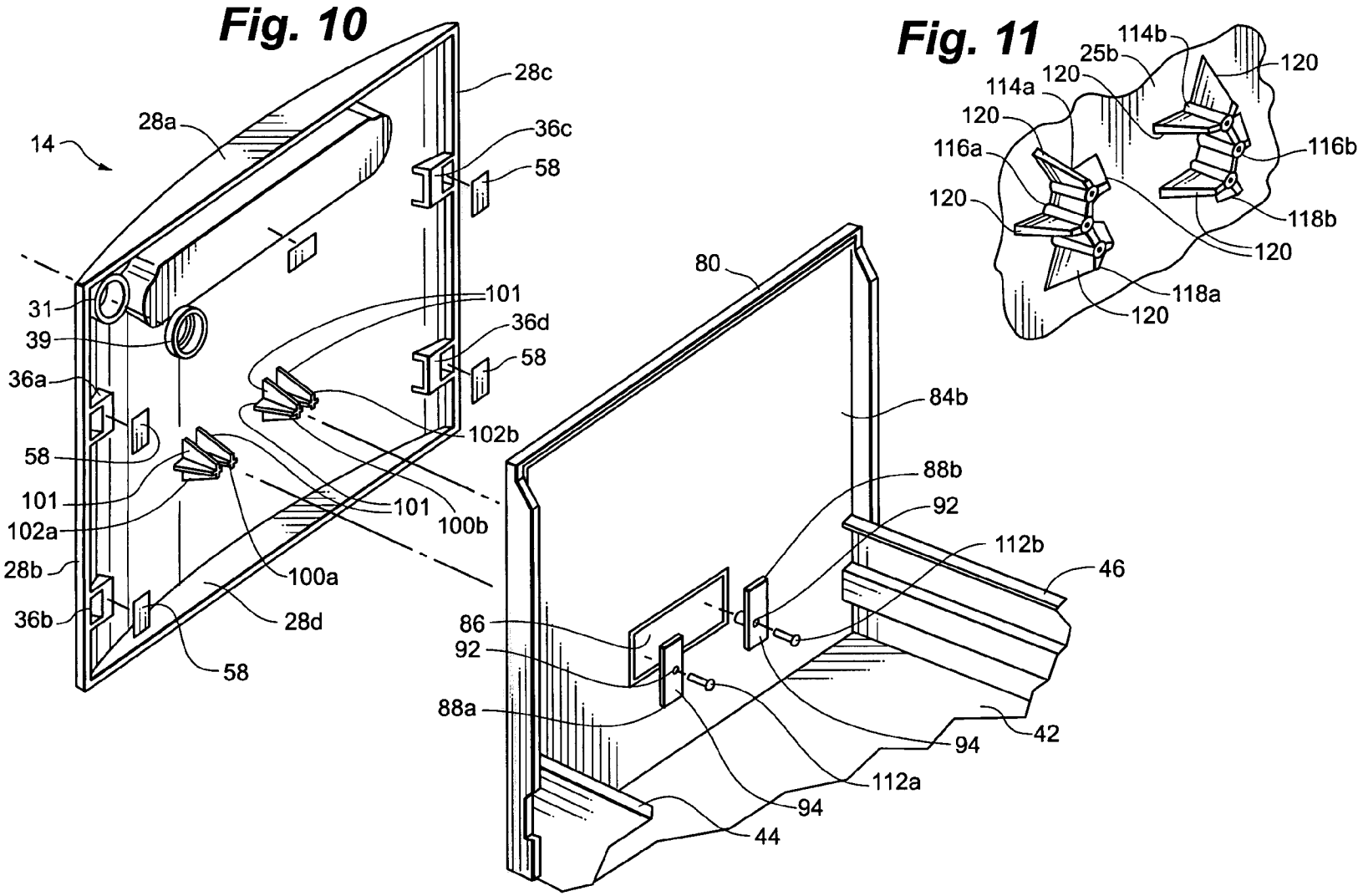
FIG. 10 is an exploded, fragmentary rear perspective view of a drawer front similar to the drawer front of FIG. 2 attached to a drawer front wall in accordance with an alternate embodiment of the present invention.
FIG. 11 is fragmentary perspective view of multiple pairs of mounting ribs in accordance with an alternate embodiment of the invention.
Figure 12:
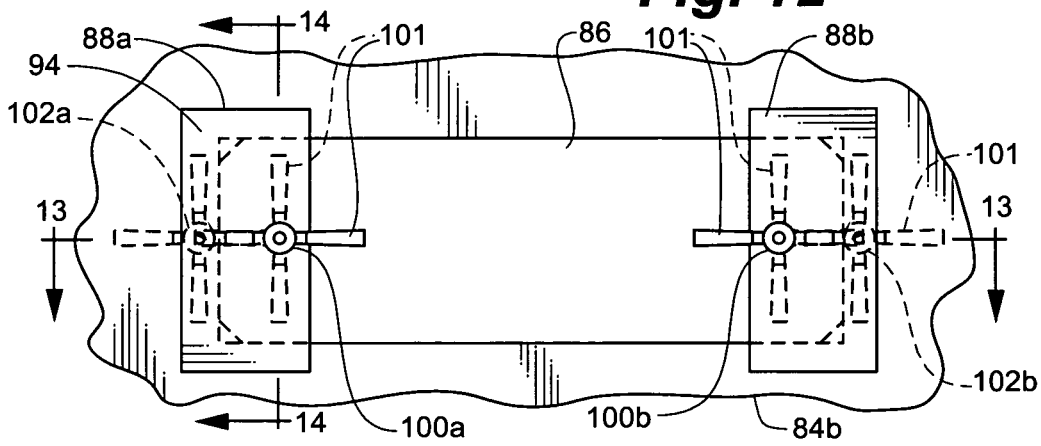
FIG. 12 is a fragmentary rear elevation view of a bridging member attached to a mounting rib in accordance with an alternate embodiment of the invention.
Figure 13:
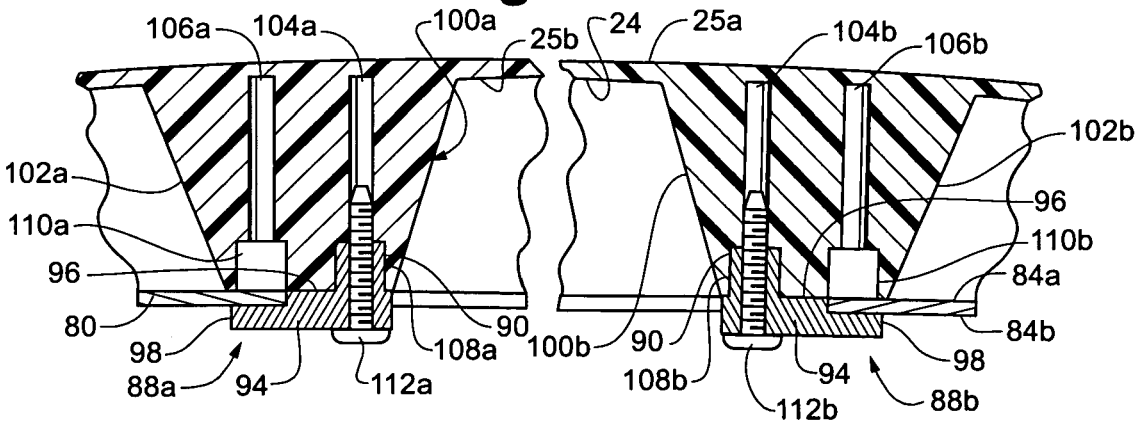
FIG. 13 is a sectional view taken along line 13—13 of FIG. 12 illustrating the mounting rib attached to a bridging member.

Rear side of cover panel 25*b* has multiple pairs of mounting ribs, inner mounting ribs 100*a* and 100*b* and outer mounting ribs 102*a* and 102*b* as shown in FIGS. 10 and 12–13. Each mounting rib has a plurality of stabilizing fins 101 and a corresponding elongated rib aperture 104*a*, 104*b*, 106*a* and 106*b* for receiving a fastening device such as a screw, nail or bolt, for example. The rearmost portion of each mounting rib also has a corresponding cavity 108*a*, 108*b*, 110*a* and 110*b* adapted to receive pin portion 90 of the bridging member. The rear side of drawer front 14 is placed against drawer face 84*a*. Screws 112*a* and 112*b* are inserted into pin aperture 92 of bridging member 88*a* and 88*b*, respectively. Screws 112*a* and 112*b* each extend through pin portion 90 of respective bridging members 88*a* and 88*b* with screw 112*a* threadably engaging the interior surface of elongated aperture 104*a* and screw 112*b* threadably engaging the interior surface of elongated aperture of 104*b* as shown in FIG. 13.

Figure 14:
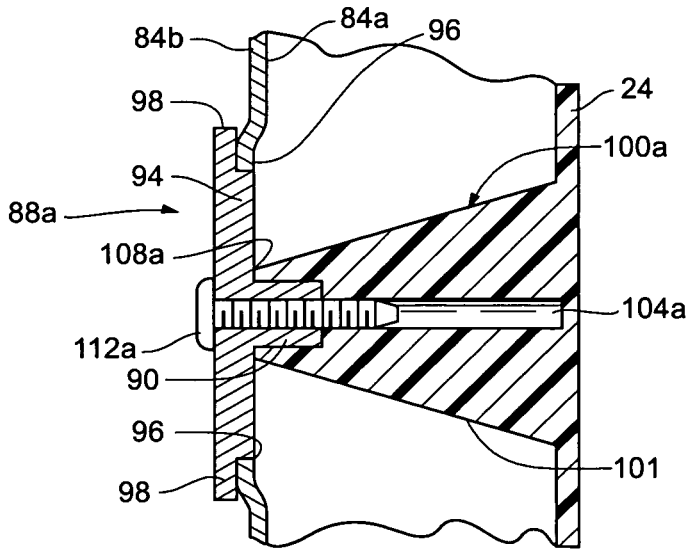
FIG. 14 is a sectional view taken along line 14—14 of FIG. 12 illustrating a mounting rib attached to a bridging member.

Bridging member 88*a* extends across the width of opening 86 as shown in FIG. 14. Flange portion 98 overlaps a portion of rear surface 84*b*. Lip 96 abuts against the inner surfaces of opening 86. Pin portion 90 fits in mated relation into cavity 108*a*. Note that the cavity in the rearmost portion of the mounting rib may be suitably dimensioned to receive either the elongated body portion of a bushing or the pin portion of a bridging member. Screw 112*a* extends through pin portion 90 and threadably engages with the interior surface of elongated aperture 104*a*.

Multiple pairs of mounting ribs serve two purposes. First, the multiple pair of mounting ribs provides versatility by enabling the same drawer front to attach to drawer faces having different sized openings. FIG. 12 shows bridging members secured to inner mounting ribs 100*a* and 100*b* and outer mounting ribs 102*a* and 102*b* providing additional offset support between the cover panel and the drawer face. In the event, however, that a drawer front wall has a longer or wider opening, bridging members 88*a* and 88*b* may be secured to outer mounting ribs 102*a* and 102*b*.

Multiple pairs of mounting ribs also provide additional support and strength to the drawer front. As shown in FIG. 13, inner mounting ribs 100*a* and 100*b* are used to secure drawer front 14 to drawer face 84*a*. The rearmost portions of outer mounting ribs 102*a* and 102*b* contact drawer face 84*a* opposite the contact location of flange portion 98 with rear surface 84*b*. This sandwiching of drawer wall 80 between flange portion 98 and the rearmost portion of outer ribs 102*a* and 102*b* stabilizes bridging members 88*a* and 88*b* within opening 86 and reduces the stress on the portion of drawer front wall 80 surrounding opening 86.

FIG. 11 shows an alternate embodiment wherein three pairs of mounting ribs, upper pair 114*a* and 114*b*, outer pair 116*a* and 116*b* and lower pair 118*a* and 118*b* extend rearwardly from rear side 25*b* of cover panel 24. A plurality of stabilizing fins 120 support and reinforce each rib, particularly as the mounting ribs offset the cover panel from the drawer face. Each rib has a corresponding rib aperture for securably receiving a fastening device as previously described. In conjunction with the bridging members, this triple-pair mounting rib configuration provides great versatility by enabling the drawer front to attach to drawer front walls having openings of various sizes. Thus, only a few parts (i.e., screws, bushings and/or bridging members) are used for installing the drawer front of the present invention to a multitude of drawer face types and designs.

The present invention further contemplates a method of attaching a drawer front to an existing drawer front wall. The method entails the provision of a cover panel dimensioned to substantially cover the drawer front wall, as previously described. The cover panel has at least one mounting rib extending rearwardly from a generally central portion of the cover panel rear side. The method includes attaching the mounting rib to the front drawer face and offsetting with the mounting rib the front side of the cover panel from the front face of the drawer. This gives the front drawer face the appearance of having depth. The method may further include removing a handle from the front drawer wall to expose holes or an opening in the front drawer wall. A fastening device may then be inserted through the hole and into the mounting rib to secure the front drawer face to drawer front. When the hole is large, a bridging member is placed within the opening to span the opening to maintain a fastening device in the opening.

The cover panel may include a plurality of projections extending rearwardly from the cover panel rear side with each projection having a rearmost surface substantially coplanar with each other and substantially coplanar with the rearmost portion of the rib. The method may further include fastening the cover panel to the drawer face so that the most rearward portions of the rib and the projections are in a fixed, abutting relation to the drawer face.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

What is claimed is:

1. A drawer front for attachment over an existing front face of a drawer, comprising:

a cover panel having a front side and a rear side;

a mounting rib extending from a generally central portion of the rear side and having a rearmost portion adapted to permit the front side of the cover panel to be offset from the existing drawer front face when attached to the existing drawer front face and said mounting rib adapted to be fastened to said front face to provide the appearance of a drawer front face having depth; and at least one member projecting rearwardly from the rear side of the cover panel and having a rearmost surface substantially coplanar with and spaced from the rearmost rib portion for offsetting the cover panel from the front face of the existing drawer front;

a fastening device extendible through a generally central portion of the drawer face corresponding to the location of the mounting rib, a portion of the fastening device adapted to be secured in a rib aperture in the mounting rib for attaching the cover panel to the existing drawer front face;

a bridging member adapted for bridging a recessed handle aperture in the existing drawer front face, the bridging member having an aperture therein permitting the fastening device to extend through said aperture.

2. The drawer front of claim 1 wherein the cover panel front side has a generally rectangular shape and rearwardly extending perimeter sidewalls spanning rearwardly from the cover panel perimeter to the existing drawer front face.

3. The drawer front of claim 2 further comprising a plurality of projections located in spaced apart relation generally along the rear perimeter of the cover panel, the projections extending generally rearwardly and having a rearmost surface, each rearmost surface being substantially coplanar.

4. The drawer front of claim 3 further comprising an adhesive material on at least a portion of each projection, the adhesive material being suitable for securing the projection to the drawer face.

5. The drawer front of claim 1 wherein the sidewall is integral to the front side of the cover panel.

6. The drawer front of claim 1 wherein the cover panel has thickness and the sidewall provides the appearance of a drawer face made of a solid material having a thickness substantially greater than the thickness of the cover panel.

7. The drawer front of claim 1 wherein the rearmost surface of the projection and the rearmost surface of the mounting rib are substantially coplanar.

8. The drawer front of claim 7 further comprising a recessed drawer pull wherein said recessed drawer pull has a most rearward surface that is coplanar with the mounting rib.

9. The drawer front of claim 1 wherein two of said projections are each present along left and right side perimeter locations of the drawer front.

10. The drawer front of claim 9 wherein the rearmost surface of each of said projections is substantially planar.

11. The drawer front of claim 1 further comprising a second rib spaced from said mounting rib and extending from the rear side and having a rearmost portion coplanar with the rearmost portion of the mounting rib and adapted to permit the front side of the cover panel to be offset from the existing drawer front face when attached to the existing drawer front face.

12. The drawer front of claim 1 wherein said mounting rib includes a second aperture spaced from the rib aperture and the bridging member includes a mating projection configured to fit within said second aperture when the fastening device is secured within the rib aperture.

13. The drawer front of claim 12 wherein the cover panel front side is convex.

14. The drawer front of claim 1 further comprising a recessed drawer pull.

15. A cabinet comprising the drawer front of claim 1, a cabinet housing and at least one cabinet drawer having a front panel, the drawer front attached to the front panel.

16. A drawer front for attachment to an existing front face of a drawer, comprising:

a cover panel for covering the front face of the drawer, the cover panel having a front side and a rear side;

means for attaching the cover panel to the drawer face; and means for offsetting the front side of the cover panel from the drawer face to provide the appearance of a drawer face having depth, wherein said offsetting means comprises a plurality of projections located in spaced apart relation generally alone the rear perimeter of the cover panel, the projections extending generally rearwardly and having a rearmost surface, each rearmost surface being substantially coplanar; and an adhesive material on at least a portion of each projection, the adhesive material being suitable for securing the projection to the drawer face;

wherein the cover panel front side has a generally rectangular shape and rearwardly extending perimeter sidewalls spanning rearwardly from the cover panel perimeter to the existing drawer front face.

17. A cabinet comprising the drawer front of claim 16, a cabinet housing, at least one drawer having a front drawer panel, and the drawer front attached to the front drawer panel.

18. A method of attaching a drawer front to an existing front face of a drawer having a front face, comprising:

removing a handle from the front face of the drawer to expose an existing opening in the front face;

providing a cover panel sized to cover the front face of the drawer, said cover panel having a front side and a rear side and a mounting rib extending rearwardly from a generally central portion of the rear side;

attaching the mounting rib to the front face of the drawer; and offsetting with the mounting rib the front side of the cover panel from the front face of the drawer to provide the appearance of a drawer face having depth.

19. The method of claim 18 wherein the mounting rib further comprises an aperture adapted to securably receive a fastening member and inserting a fastening member through the opening and into a portion of the rib aperture to secure the mounting rib to the drawer front face.

20. The method of claim 19 wherein the existing opening in the front face of the drawer is large and further comprising placing a bridging member that spans the opening and inserting the fastening member through the bridging member to maintain the fastening device in the opening.

21. The method of claim 19 wherein the cover panel further comprises a plurality of projections extending generally rearwardly from the rear side of the cover panel, each projection having a rearmost surface substantially coplanar with each other and the rib, the method further comprising fastening the cover panel to the drawer face so that the most rearward portions of the rib and the projections are in a fixed, abutting relation to the drawer face.

22. A drawer front for attachment over an existing front face of a drawer, comprising:

a cover panel having a front side and a rear side;

a mounting rib extending from a generally central portion of the rear side and having a rearmost portion adapted to permit the front side of the cover panel to be offset from the existing drawer front face when attached to the existing drawer front face and said mounting rib adapted to be fastened to said front face to provide the appearance of a drawer front face having depth; and at least one member projecting rearwardly from the rear side of the cover panel and having a rearmost surface substantially coplanar with and spaced from the rearmost rib portion for offsetting the cover panel from the front face of the existing drawer front;

a plurality of projections located in spaced apart relation generally along the rear perimeter of the cover panel, the projections extending generally rearwardly and having a rearmost surface, each rearmost surface being substantially coplanar; and an adhesive material on at least a portion of each projection, the adhesive material being suitable for securing the projection to the drawer face;

wherein said cover panel is of a dimension which is equal to or less than a dimension of the existing front face of the drawer;

and wherein the cover panel front side has a generally rectangular shape and rearwardly extending perimeter sidewalls spanning rearwardly from the cover panel perimeter to the existing drawer front face.

23. A drawer front for attachment over an existing front face of a drawing, comprising:

a cover panel having a front side and a rear side;

a mounting rib extending from a generally central portion of the rear side and having a rearmost portion adapted to permit the front side of the cover panel to be offset from the existing drawer front face when attached to the existing drawer front face and said mounting rib adapted to be fastened to said front face to provide the appearance of a drawer front face having depth; and at least one member projecting rearwardly from the rear side of the cover panel and having a rearmost surface substantially coplanar with and spaced from the rearmost rib portion for offsetting the cover panel from the front face of the existing drawer front wherein the rearmost surface of the projections and the rearmost surface of the mounting rib are substantially coplanar; and a drawer pull wherein said recessed drawer pull has a most rearward surface that is coplanar with the mounting rib.

* * * * *

UNITED STATES PATENT AND TRADEMARK OFFICE

CERTIFICATE OF CORRECTION

PATENT NO. : 6,948,788 B1
DATED : September 27, 2005
INVENTOR(S) : Chung Chee Tai It is certified that error appears in the above-identified patent and that said Letters Patent is hereby corrected as shown below:

Column 12,
Line 5, delete "alone" and insert -- along --.

Signed and Sealed this

Twenty-seventh Day of June, 2006

JON W. DUDAS
*Director of the United States Patent and Trademark Office*